US005657652A

United States Patent [19]

Martin

[11] Patent Number: 5,657,652

[45] Date of Patent: Aug. 19, 1997

[54] PIN TUMBLER CABINET DOOR AND DRAWER DEADLOCKING LATCH-LOCK

[75] Inventor: Frank J. Martin, Seattle, Wash.

[73] Assignee: Frank J. Martin Company, Seattle, Wash.

[21] Appl. No.: 523,363

[22] Filed: Sep. 5, 1995

[51] Int. Cl.[6] ..... E05B 65/46

[52] U.S. Cl. ..... 70/85; 70/81; 70/107

[58] Field of Search ..... 70/78, 81, 82, 70/85, 86, 99, 100, 107, 110, 134, 141, 144, 150, 151 R, 379 R, 380, 371, DIG. 62; 292/147

[56] References Cited

U.S. PATENT DOCUMENTS

| | | | |
|---|---|---|---|
| 2,046,630 | 7/1936 | Jacobi | 70/81 |
| 2,275,362 | 3/1942 | Golden et al. | 70/380 X |
| 2,306,022 | 12/1942 | Lach | 70/81 |
| 3,316,001 | 4/1967 | Russell et al. | 70/150 X |
| 3,621,685 | 11/1971 | Sargent | 70/107 |
| 3,672,714 | 6/1972 | Schultz | 70/107 X |
| 3,769,822 | 11/1973 | Yulkowski | 70/107 |
| 3,824,817 | 7/1974 | Orr | 70/81 |
| 3,881,331 | 5/1975 | Tranberg et al. | 70/107 |
| 3,919,866 | 11/1975 | Upschultz | 70/81 |
| 4,012,928 | 3/1977 | Dauenbaugh | 70/81 |
| 4,031,725 | 6/1977 | Reid | 70/107 |
| 4,583,382 | 4/1986 | Hull | 70/107 |
| 4,870,841 | 10/1989 | Cudd | 70/107 |
| 5,469,723 | 11/1995 | Utwin et al. | 70/107 |

OTHER PUBLICATIONS

Olympus Lock Product Catalog, Apr., 1992, p. 6—Deadlocking Commercial Drawer Lock—850SC.

*Primary Examiner*—Suzanne Dino
*Attorney, Agent, or Firm*—Richardson & Folise

[57] ABSTRACT

A deadlocking, self-latching lock for cabinet doors and drawers employs a unitary shell with an adjacent main bolt and self-latching deadlocking bolt. A pivoting locking arm prevents external retraction of the main bolt without the use of a key.

7 Claims, 2 Drawing Sheets

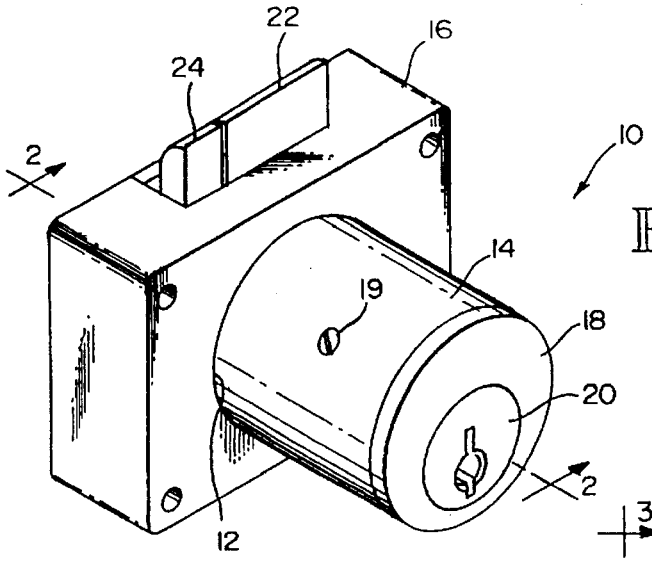
FIG. 1
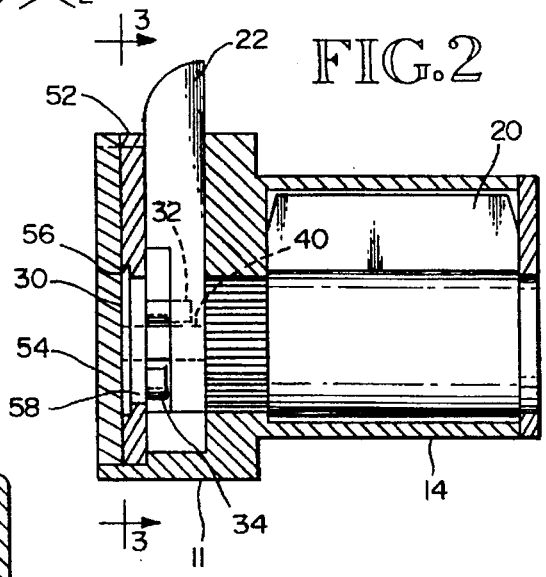
FIG. 2
FIG. 3
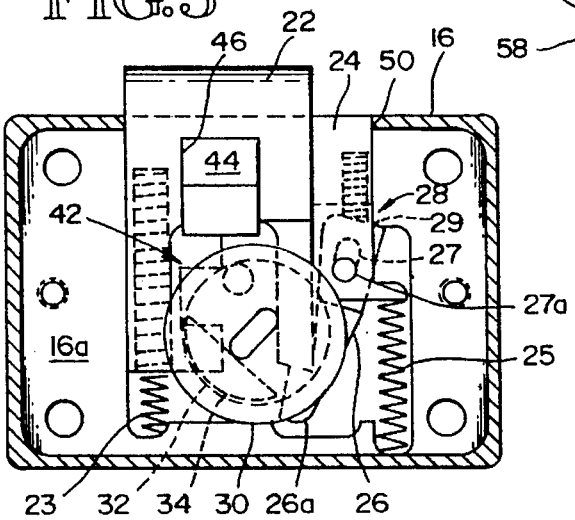
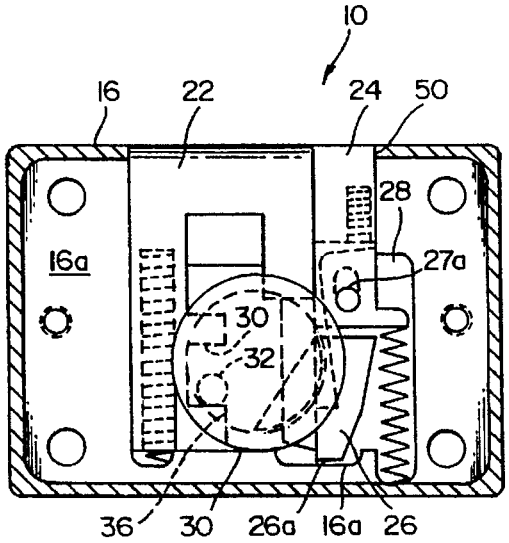
FIG. 4

PIN TUMBLER CABINET DOOR AND DRAWER DEADLOCKING LATCH-LOCK

TECHNICAL FIELD

The invention relates to pin tumbler cabinet door and drawer locks. More specifically, the invention relates to self-latching locks for cabinet doors and drawers.

BACKGROUND OF THE INVENTION

Deadlocking self-latching locks for entryways have been available for some time for use on exterior home doors, and office doors in the United States. Locks of this type employ a spring-mounted main bolt having one curved or sloping face, and a cooperative deadlocking bolt which when depressed prevents retraction of the main bolt. In a lock of this type, a lock strike plate on the door jam permits passage of the main bolt therethrough, but depresses the deadlocking bolt. The door can thus be closed and locked from the outside without the use of a key. However, it cannot be reopened from the outside without the use of a key.

Many self-latching locks for cabinet doors and drawers have also been developed. However, pin tumbler deadlocking self-latching cabinet door and drawer locks are not generally available. U.S. Pat. No. 4,012,928 to Dauenbaugh and assigned to Keystone Consolidated Industries, Peoria, Ill., describes a self-latching, mortise-type cabinet lock for use in desk drawers and the like. The latch on this lock is not of the deadlocking type found in entryway doors. Non-deadlocking latch locks can be defeated by inserting thin material between the interfacing bolt and striker surfaces, such as a credit card to depress the latch bolt against its main spring. For these reasons, self-latching cabinet door and drawer locks have not been applied to security installations.

There are currently very large quantifies of dead bolt pin tumbler cabinet door and drawer locks installed in the United States. Locks of this type do not apply a spring bias to the bolt. Rather, the bolt is driven by rotation of a plug within a cylinder plug assembly. If the cylinder and plug assembly is of the pin tumbler variety, these locks are highly secure and as shown by the line of locks manufactured by Olympus Lock, Inc., Seattle, Wash. can be readily rekeyed. Nevertheless, a key is required to both lock and unlock cabinet doors and drawers fitted with locks of this type. It would be extremely advantageous to apply the security of a dead bolt-type cabinet door and drawer lock, with the convenience of a deadlocking self-latching entryway door lock.

SUMMARY OF THE INVENTION

It is therefore an object of the present invention to provide a deadlocking latch lock for pin tumbler cabinet doors and drawers.

It is a further object of the invention to achieve the above object with a deadlocking latch lock having the same dimensions as dead bolt-type cabinet door and drawer locks so that existing installations can be refitted with the new lock with the deadlocking feature.

The invention achieves these objects, and other objects and advantages which will become apparent from the description which follows, by providing a self-latching dead lock for cabinet doors and drawers having a spring-loaded, self-latching main bolt adjacent to a spring-loaded, self-latching deadlocking bolt. A locking mechanism automatically interconnects the deadlocking bolt and the main bolt so that when the main bolt is extended and the deadlocking bolt depressed, the main bolt is locked in an extended position. The locking mechanism is released by rotation of a key and a plug associated therewith.

In a preferred embodiment of the invention, a cam mechanism is journaled for rotation with the plug. The cam mechanism has a portion thereon for driving the main bolt, and a disengaging segment thereon for disengaging the locking mechanism on the deadlocking bolt from the main bolt so that the main bolt can be retracted by operation of a key.

In order to accommodate the dimensions of a standard deadlock cabinet door and drawer lock (i.e. of the non self-latching type), the cam mechanism is positioned behind the main bolt so that the self-latching main bolt is longitudinally positioned with respect to the lock body at the same position of a conventional non self-latching dead bolt. In this way, the invention is interchangeable with existing conventional cabinet door and drawer locks of similar size.

BRIEF DESCRIPTION OF THE DRAWINGS

FIG. 1 is an environmental, isometric view of a deadlocking latch lock of the present invention.

FIG. 2 is a cross-sectional, elevational view of the lock shown in FIG. 1 taken along lines 2—2 of FIG. 1.

FIG. 3 is a cross-sectional, elevational view taken along lines 3—3 of FIG. 2 showing the main bolt of the lock in an extended position, and a deadlocking bolt of the invention in a retracted position so as to lock the main bolt.

FIG. 4 is a sectional, elevational view similar to FIG. 3 in which a cam mechanism has been counter-rotated by a key (not shown) to retract the main bolt and disengage a locking mechanism therefrom.

BEST MODE FOR CARRYING OUT THE INVENTION

Figure 5:
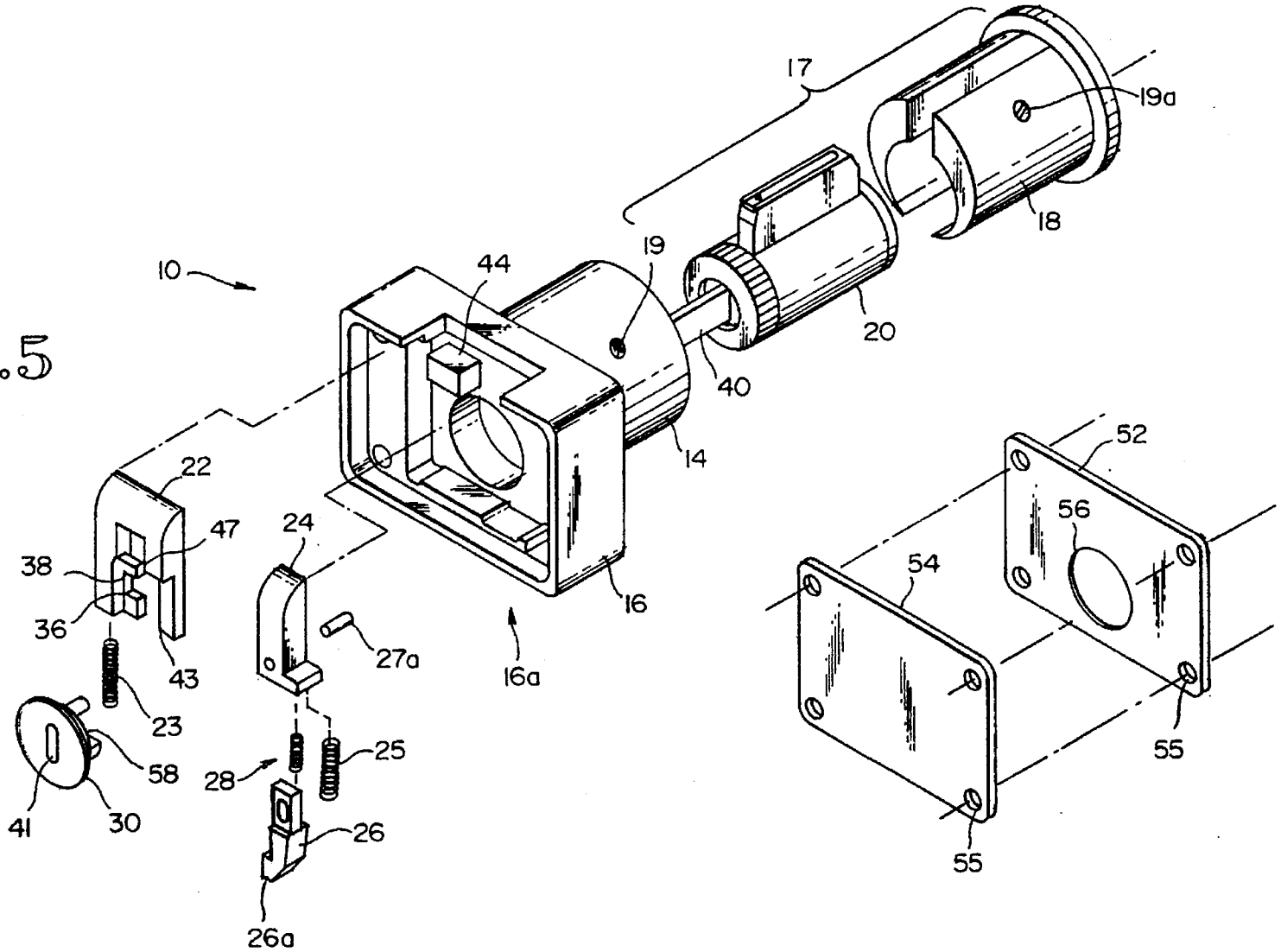
FIG. 5 is an exploded, isometric rear view of the lock.

A deadlocking latch lock for cabinet doors and drawers is generally indicated at reference numeral 10 in FIG. 1. The lock is preferably provided with a unitary shell 12 manufactured from a casting of brass or other suitable material. As best seen in FIG. 5, the shell has an elongated, cylinder housing portion 14, and an integral bolt housing portion 16. The cylinder housing portion is smooth and hollow and thus adapted for receiving a cylinder and plug assembly 17 in a forwardly direction. The cylinder and plug assembly may be of many conventional forms and is preferably of the type having a shell or cylinder 18 for housing a plug 20 which is commonly referred to as the "insert cylinder" type. It is to be understood that other types of cylinder and plug assemblies, such as the interchangeable core type, and other pin tumbler cylinder and plug assemblies may be substituted, as will be apparent to those of ordinary skill in the art.

The cylinder housing portion 14 is preferably provided with an aperture 19 which is registerable with a corresponding aperture **19*a*** on the cylinder for receiving a set screw as set forth in more detail in U.S. Pat. No. 4,899,563 which is titled "Re-keyable Pin Tumbler Cabinet Drawer Lock and Pin Tumbler Cabinet Door Lock," the disclosure of which is incorporated herein by reference. Alternatively, a push button release mechanism may be employed, as set forth in further detail in U.S. Pat. No. 5,121,619 titled "Speed Release Mechanism for Cylinder and Plug Assembly for Use with Cabinet Locks," the disclosure of which is incorporated herein by reference.

With reference to FIG. 1, the bolt housing portion 16 reciprocally receives a self-latching type main bolt 22 having a curved face thereon for engagement with a strike (not shown) on an opposing surface such as a doorjamb or drawer sill. The main bolt 22 is biased outwardly by a main bolt compression spring 23, best seen in FIG. 3. The bolt housing portion 16 also receives a self-latching type deadlocking bolt 24 also having a curved face thereon positioned adjacent to the main bolt 22 for reciprocating motion within the housing. The deadlocking bolt is also outwardly biased by a separate deadlocking bolt compression spring 25. It is apparent that upon forcing the curved surfaces of the main and deadlocking bolts against a suitable strike, the bolts will depress their respective compression springs until they fall behind the strike surface into an appropriate mortise, whereupon the compression spring 23 will extend the main bolt into an outwardly, locked position. To prevent retraction of the main bolt other than by use of a suitable key, the portion of the strike which engages the deadlocking bolt 24 is not provided with a mortise (or cutout). Thus, the deadlocking bolt 24 remains in the retracted position.

A locking arm 26 is pinned to the deadlocking bolt 24 by a pin 27*a* through an oblong aperture 27 on the locking arm. A spring-biased mechanism 28 acts against an eccentrically located surface 29 of the locking arm 26, thereby biasing the locking arm to rotate in a clockwise direction. A free end 26*a* of the locking arm therefore engages a slanted surface of the main bolt 22, preventing the main bolt from being retracted by an external force due to interference of the free end 26*a* of the locking arm with the interior 16a of the bolt housing 16. The aperture 27 is elongated so that the free end 26*a* of the locking cam can rotate into a locking position without interference from the interior of the bolt housing 16, while still being capable of bottoming out against the bottom of the housing interior if the main bolt 22 is depressed.

In order to release the main bolt, the lock 10 is provided with a cam mechanism 30 having a main bolt driving pin 32 extending longitudinally therefrom and a crescent-shaped locking-arm disengaging segment 34 positioned thereon. When counter-rotated (e.g. in a counterclockwise direction) from the position shown in FIG. 3 to the position shown in FIG. 4, the disengagement segment pushes the locking arm 26 out from underneath the main bolt 22 while the driving pin 32 bears against a retracting surface 36 of the main bolt to retract the bolt against the urging of its compression spring 23. Conversely, the main bolt 22 can be extended by rotating the cam mechanism in the clockwise direction as shown in FIGS. 3 and 4, so that the driving pin 32 urges against an extending surface 42 of the bolt 22 as shown in FIG. 3 to extend the bolt and permit the locking arm 26 to reengage the slanted surface of the bolt, thus locking the bolt in the extended position.

In order to rotatably connect the cam mechanism 30 with the plug 20, a tailpiece 40 is engaged with the plug in the conventional manner as shown in FIG. 5. The tailpiece is of the blade type and engages a slot 41 in the cam 30. The main bolt 22 is provided with a main aperture 43, allowing passage of the tailpiece therethrough. By placing the cam mechanism behind the bolt 22 as shown in FIG. 5, the main bolt and deadlocking bolt can be positioned in the same plane as is a conventional non self-latching deadlocking bolt. Thus, the lock 10 can be retrofitted into existing installations employing conventional deadlocking cabinet door and drawer locks. This structural characteristic is highly advantageous from a commercial point of view.

The bolt housing portion 16 can preferably be provided with a guide portion 44 for interaction with guide surfaces 46, 47 on the main bolt to guide its reciprocal motion into and out of the bolt housing. The main bolt itself, along with an interior wall 50 of the bolt housing, guides the reciprocal motion of the deadlocking bolt.

As best seen in FIGS. 2 and 5, a rear portion of the bolt housing 16 is closed by a cam bearing plate 52 and a back plate 54. Both the cam bearing plate and the back plate have apertures 55 therein for mating with corresponding apertures in the bolt housing for accepting the conventional cabinet mounting screws. In addition, the cam bearing plate 52 has a two-step main aperture 56, best seen in FIG. 2, for providing a rotational bearing surface for a raised peripheral rim 58 on the cam mechanism. The step shape of the aperture also forms a forward thrust bearing for the cam mechanism 30. The back plate 54 provides a rearward thrust bearing for the cam mechanism.

Those of ordinary skill in the art will conceive of other embodiments of the invention which conform to the basic spirit of the disclosure above. The invention is therefore not to be limited by the above disclosure but is to be determined in the scope by the claims which follow.

I claim:

1. A deadlocking latch lock for cabinet doors and cabinet drawers, comprising:

a unitary shell having an elongated cylinder housing portion extending from a bolt housing portion, the cylinder housing portion removably retaining a cylinder and a rotatable plug as an assembly, the bolt housing portion receiving a reciprocal main bolt;

a retractable main bolt spring-biased to an extended position;

a retractable deadlocking bolt supported within the bolt housing portion, adjacent to the main bolt and spring-biased to an extended position;

only one locking arm directly pivotally connected to the deadlocking bolt and having an engaged position with respect to the main bolt to prevent retraction of the main bolt and a disengaged position with respect to the main bolt to allow retraction of the main bolt;

a spring-bias mechanism for biasing the locking arm to the engaged position with the main bolt for preventing retraction of the main bolt when the deadlocking bolt is depressed; and, a cam mechanism journaled for rotation with the plug, the cam having a main bolt driving pin extending therefrom and engageable with the main bolt and a peripheral locking arm disengagement segment for disengaging the locking arm from the main bolt upon rotation of the plug, whereby rotation of the plug to a first position disengages the locking arm and further rotation to a second position retracts the main bolt.

2. The lock of claim 1, wherein the plug defines a longitudinal lock axis and wherein the plug has a tailpiece extending longitudinally into the bolt housing portion, wherein the main bolt defines an aperture for passage of the tailpiece therethrough, and wherein the cam mechanism is connected to the tailpiece, is journaled for rotation within the bolt housing, and is located longitudinally behind the main bolt.

3. The lock of claim 1, wherein the cylinder housing defines a longitudinal axis and the main bolt is located intermediate the cam mechanism and the plug and is within the bolt housing portion.

4. The lock of claim 3, wherein the bolt defines a main aperture for passage therethrough of a tailpiece rotatably interconnecting the cam mechanism with the plug.

5. The lock of claim 1, wherein the locking arm defines an oval aperture for receipt of a cylindrical pin attached to the deadlocking bolt to provide relative longitudinal movement between the deadlocking bolt and the locking arm.

6. A deadlocking latch lock for cabinet doors and drawers, comprising:

an elongated cylinder housing portion and a bolt housing portion, the cylinder housing portion removably retaining a cylinder and plug assembly;

a retractable main bolt received in the bolt housing portion and spring-biased to an extended position;

a retractable deadlocking bolt supported within the bolt housing portion, adjacent to the main bolt and spring-biased to an extended position;

a single locking arm directly pivotally connected to the deadlocking bolt and having an engaged position with respect to the main bolt to prevent retraction of the main bolt and a disengaged position with respect to the main bolt to allow retraction of the main bolt;

a spring-bias mechanism for biasing the locking arm to the engaged position with the main bolt for preventing retraction of the main bolt when the deadlocking bolt is depressed; and, a cam mechanism journaled for rotation with a plug of the cylinder and plug assembly, the cam having a main bolt driving pin extending therefrom and engaged with the main bolt and a peripheral locking arm disengagement segment for disengaging the locking arm from the main bolt upon rotation of the plug, whereby rotation of the plug to a first position disengages the locking arm and further rotation to a second position retracts the main bolt.

7. The lock of claim 6, wherein the plug defines a longitudinal lock axis and wherein the plug has a tailpiece extending longitudinally into the bolt housing portion, wherein the main bolt defines an aperture for passage of the tailpiece therethrough, and wherein the cam mechanism is connected to the tailpiece, is journaled for rotation within the bolt housing, and is located longitudinally behind the main bolt.

* * * * *